US006407488B1

(12) United States Patent
Ragland, Jr.

(10) Patent No.: US 6,407,488 B1
(45) Date of Patent: Jun. 18, 2002

(54) COLOR PICTURE TUBE HAVING A LOW EXPANSION TENSION MASK

(75) Inventor: Frank Rowland Ragland, Jr., Lancaster, PA (US)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/283,548

(22) Filed: Apr. 1, 1999

(51) Int. Cl.[7] ..... H01J 29/07

(52) U.S. Cl. ..... 313/402; 313/403; 313/407; 445/30; 445/37

(58) Field of Search ..... 313/402, 403, 313/407; 445/30, 37

(56) References Cited

U.S. PATENT DOCUMENTS

| | | | | |
|---|---|---|---|---|
| 3,638,063 A | | 1/1972 | Tachikawa et al. | 313/348 |
| 3,808,493 A | * | 4/1974 | Kawamura et al. | 313/85 |
| 4,645,968 A | | 2/1987 | Ragland, Jr. | 313/407 |
| 4,827,178 A | * | 5/1989 | Higashinakagawa et al. | 313/402 |
| 5,111,107 A | | 5/1992 | Kume et al. | 313/405 |
| 5,167,557 A | * | 12/1992 | Teramoto et al. | 445/47 |
| 5,309,059 A | * | 5/1994 | Kume et al. | 313/402 |
| 5,709,804 A | * | 1/1998 | Makita et al. | 216/12 |

FOREIGN PATENT DOCUMENTS

| | | | |
|---|---|---|---|
| EP | 0121628 A1 | 10/1984 | H01J/29/07 |
| EP | 0872871 A1 | 10/1998 | H01J/29/02 |
| JP | 61-131338 | 6/1986 | H01J/29/07 |
| WO | WO9848439 A | 10/1998 | H01J/29/07 |

OTHER PUBLICATIONS

PCT Search Report dated Jun. 28, 2000.
*Patent Abstracts of Japan, vol. 010, No. 319 (E–450), Oct. 30, 1986, (Toshiba Corp.).

* cited by examiner

*Primary Examiner*—Ashok Patel
*Assistant Examiner*—Sikha Roy
(74) *Attorney, Agent, or Firm*—Joseph S. Tripoli; Dennis H. Irlbeck; Carlos M. Herrera

(57) ABSTRACT

A color picture tube having a tension mask attached to a support frame, wherein the mask if made from a material having a significantly lower coefficient of thermal expansion than the coefficient of thermal expansion of the material of the frame. The frame tensions the mask to have a fundamental resonant frequency of 90 Hz±20 Hz.

5 Claims, 2 Drawing Sheets

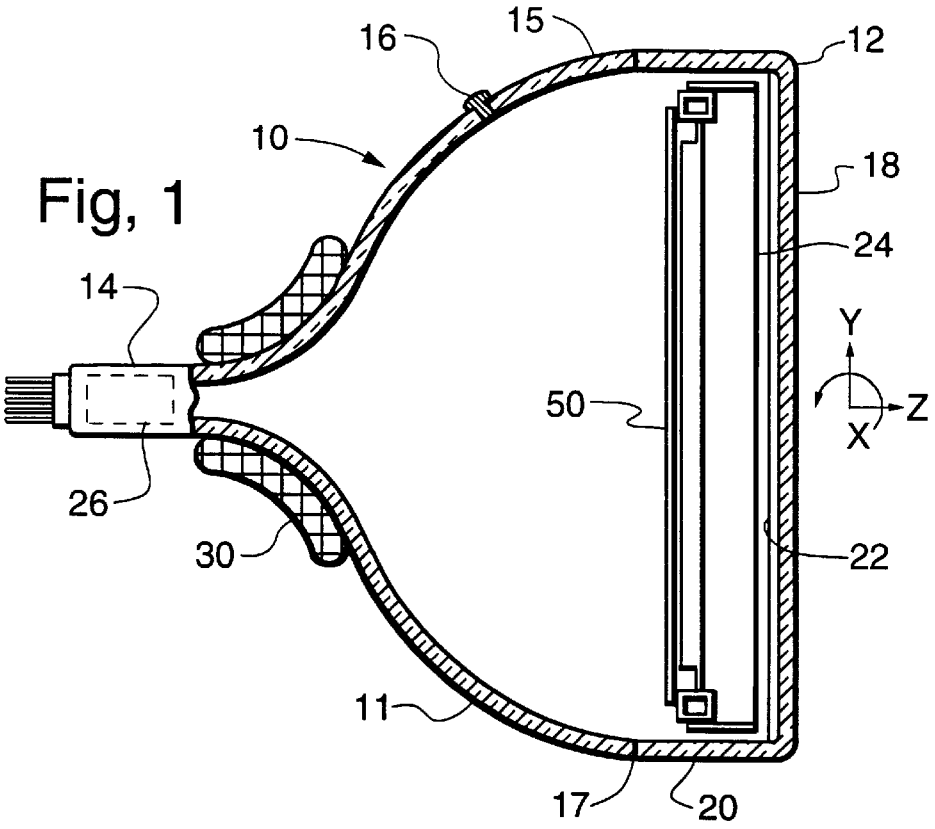
Fig, 1
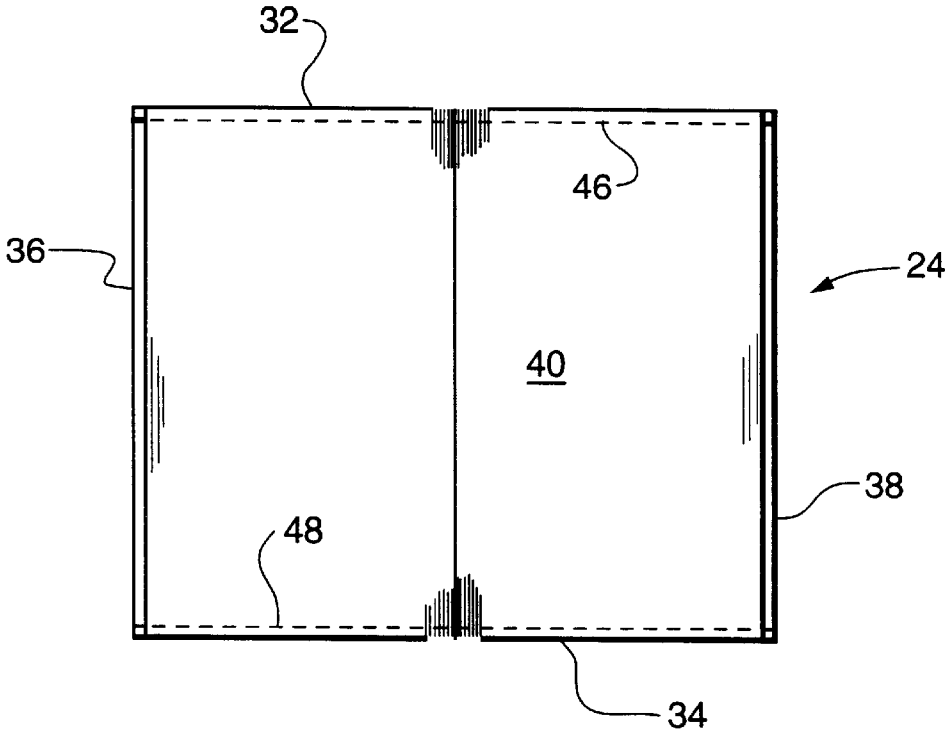
Fig. 2

COLOR PICTURE TUBE HAVING A LOW EXPANSION TENSION MASK

This invention relates to color picture tubes having tension masks, and particularly to a tube with a tension mask that is made of a low expansion material.

BACKGROUND OF THE INVENTION

A color picture tube includes an electron gun for generating and directing three electron beams to a screen of the tube. The screen is located on the inner surface of a faceplate of the tube and is made up of an array of elements of three different colors emitting phosphors. A color selection electrode or shadow mask is interposed between the gun and the screen to permit each electron beam to strike only the phosphor elements associated with that beam. A tension mask is a thin sheet of metal, such as steel, that is contoured or stretched under tension to somewhat parallel the inner surface of the tube faceplate.

A problem that must be solved in tubes utilizing tension masks is that of the loss of tension during operation, caused by thermal inputs, such as vertical blister bars. Vertical blister bars are bright areas on an otherwise dark screen that are about 3 cm wide and about 15 to 25 cm long. In the past, this problem was solved by placing the vertical mask strands of a steel mask under tensions ranging as high as 45 ksi. These high tensions produce enough strain in steel masks to overcome the thermal expansion caused by a blister bar, and to retain adequate tension under most operating conditions. However, the higher electron beam power available in modern television receivers has made the available tolerance in tension masks to thermal expansion unacceptable in some operating conditions. The high stress in a steel tension mask requires a massive mask support frame to provide the necessary tension forces to the mask. Such masks are high in both cost and weight. The high stresses in the mask and frame also require special mask and frame materials that have low thermal creep properties, thereby further increasing their costs. Furthermore, steel tension masks also require some detensioning means during high temperature processing.

The present invention recognizes that a lighter frame can be used in a tension mask tube, if the required tension on a mask is reduced. One way to reduce the required mask tension is to make the mask from a material, such as Invar, having a low coefficient of thermal expansion.

SUMMARY OF THE INVENTION

The present invention provides an improvement in a color picture tube having a tension mask attached to a support frame. The improvement comprises the mask being made from a material having a significantly lower coefficient of thermal expansion than the coefficient of thermal expansion of the material of the frame. The frame tensions the mask to have a fundamental resonant frequency of 90 Hz±20 Hz.

BRIEF DESCRIPTION OF THE DRAWINGS

FIG. 1 is a side view, partly in axial section, of a color picture tube embodying the invention.

FIG. 2 is a plane view of the tension shadow mask of the tube of FIG. 1.

DETAILED DESCRIPTION OF THE PREFERRED EMBODIMENTS

Figure 3:
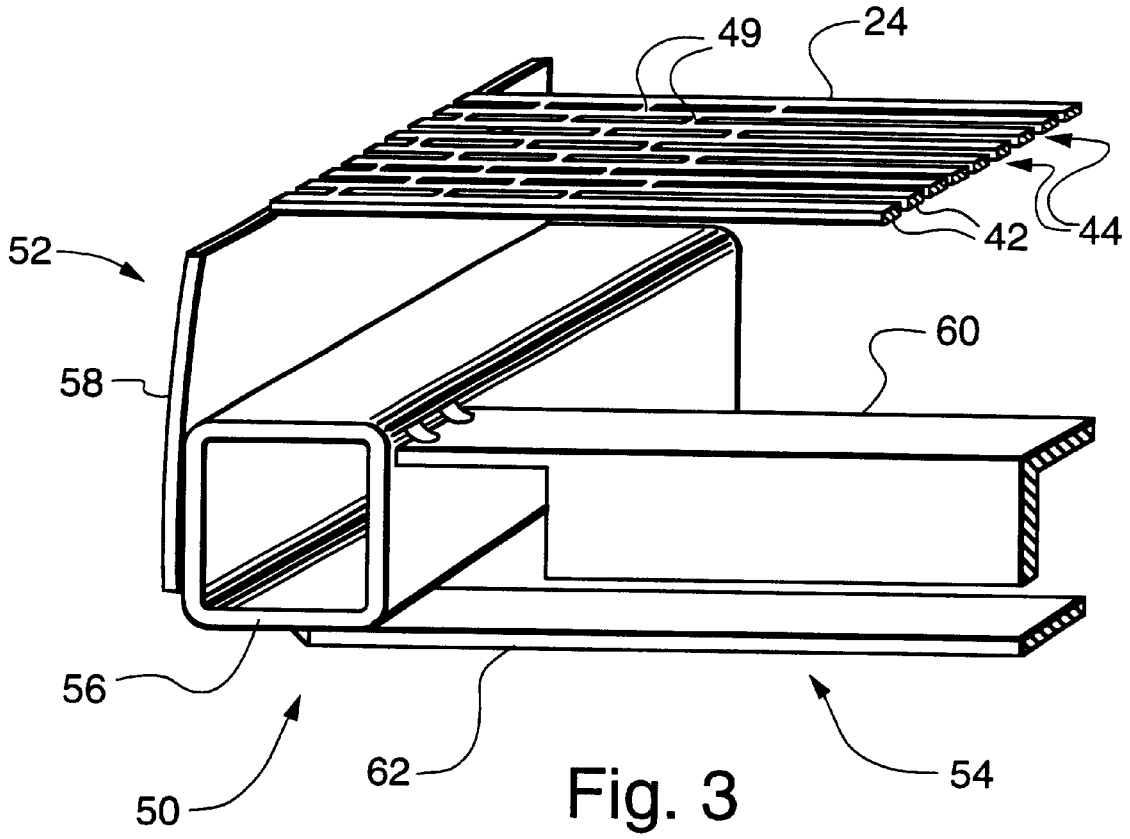
FIG. 3 is a perspective view of a corner of the tension shadow mask-frame assembly of the tube of FIG. 1.

FIG. 1 shows a color picture tube 10 having a glass envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a substantially flat viewing faceplate 18 and a peripheral flange or sidewall 20, which is sealed to the, funnel 15 by a glass frit 17. A three-color phosphor screen 22 is carried by the inner surface of the faceplate 18. The screen 22 is a line screen with the phosphor lines arranged in triads, each triad including a phosphor line of each of the three colors. A color selection tension mask 24 is removably mounted in predetermined spaced relation to the screen 22. An electron gun 26, shown schematically by dashed lines in FIG. 1, is centrally mounted within the neck 14 to generate and direct three inline electron beams, a center beam and two side or outer beams, along convergent paths through the mask 24 to the screen 22.

The tube 10 is designed to be used with an external magnetic deflection yoke, such as the yoke 30 shown in the neighborhood of the funnel-to-neck junction. When activated, the yoke 30 subjects the three beams to magnetic fields which cause the beams to scan horizontally and vertically in a rectangular raster over the screen 22.

The tension shadow mask 24, shown in FIGS. 2 and 3, includes two long sides 32 and 34, and two short sides 36 and 38. The two long sides 32 and 34 of the mask parallel a central major axis, X, of the mask; and the two short sides 36 and 38 parallel a central minor axis, Y, of the mask. The tension shadow mask 24 includes an active apertured portion 40 that contains a plurality of parallel vertically extending strands 42. A multiplicity of elongated apertures 44, between the strands 42, parallel the minor axis Y of the mask. The electron beams pass through the apertures 44 in the active portion 40, during tube operation. Each aperture 44 extends continuously from a border portion 46 at a long side 32 of the mask to another border portion 48 at the opposite long side 34. The border portions 46 and 48 may or may not include tie bars 49, such as those shown in FIG. 3.

A frame 50, for use with the tension shadow mask 24, is partially shown in FIG. 3. The frame 50 includes four sides: two long sides 52, substantially paralleling the major axis X of the tube, and two short sides 54, paralleling the minor axis Y of the tube. Each of the two long sides 52 includes a rigid section 56 and a compliant section 58 cantilevered from the rigid section. The rigid sections 56 are hollow tubes, and the compliant sections 58 are metal plates. Each of the short sides 54 has an L-shaped cross-section upper portion 60 parallel to and separated from a flat bar-shaped lower portion 62. The two long sides 32 and 34 of the tension mask 24 are welded to the distal ends of the compliant sections 58.

The mask 24 is made from a material having a relatively low coefficient of thermal expansion, compared to that of the frame 50. Preferably, the mask 24 is made from a nickel-iron alloy, such as Invar, which has a coefficient of thermal expansion of $0.9\times10^{-6}$. The frame 50 tensions the mask 24 to have a fundamental resonant frequency of 90 Hz±20 Hz, or an approximate range of 70 Hz to 110 Hz. Such fundamental resonant frequency can be achieved when the tensile stress within a strand, divided by the strand length squared, is in the approximate range of 206 to 321.5 grams per $cm^4$ (18.9 to 29.5 pounds per $inch^4$). The 90 Hz frequency is selected because it lies midway between the 60 Hz vertical scan frequency and the 120 Hz harmonic of the vertical scan frequency. This frequency is considerable less than that of the prior art tension mask tubes, which generally fall into the 160 Hz to 300 Hz range.

In one frame embodiment, the rigid section 56 of the long sides 52 are hollow square tubes of 4130 steel having a wall thickness of 0.175 cm. The thickness of the compliant sections 58 is determined by considering mask thickness, the flexibility of the total mask-frame assembly and the desired warp misregistration limits. In a further preferred embodiment, the compliant sections 58 are plates of 4130 steel that are 0.157 cm thick. The compliant sections 58 also can be bimetal plates, such as of stainless steel/stainless steel or stainless steel/Invar. The two upper portions 60 are preferably of CRS-1018 steel having a thickness of 0.318 cm. The two lower portions 62 are preferably of 300 Series stainless steel, which has a different coefficient of thermal expansion than does the CRS-1018 steel of the upper portions 60. When the frame 50 is heated, the lower portions 62 expand more than do the upper portions 60. Because of the flexible connections between the straight and curved members, the differential expansion between the lower portions 62 and the upper portions 60 relieves stress in the compliant sections 58 and tension in the mask 24, during high temperature processing.

Although the rigid sections 56 have been shown as hollow square tubes, other preferred configurations, such as those having L-shaped, C-shaped or triangular-shaped cross-sections, are also possible for these section. Furthermore, although the upper portions 60 have been shown as having L-shaped cross-sections, other preferred configurations may be C-shaped, triangular shaped or box-shaped.

The lower thermal expansion of the preferred Invar compared to steel (1:9), at operating temperatures, results in lower initial strain, and thus lower tension requirements, for the same thermal inputs. These reduced tension requirements, therefore, permit the frame to be substantially lower in mass, cost and complexity than the prior art frames used to tension steel masks. The lower modulus of Invar versus steel (2:3) allows a further reduction in initial tension, because the same mechanical strain can be induced with lower tension. Furthermore, the thermal creep properties of Invar are superior to that of previously used materials, thus allowing a further reduction in initial tension on the mask. In addition, the low tension required in an Invar tension mask precludes the need for any detensioning means during high temperature processing. Also, a tension mask constructed in accordance with the present invention maintains adequate tension during thermal inputs, such as blister bars.

What is claimed is:

1. A color picture tube having a tension mask attached to a support frame, comprising:

said tension mask being made from a material having a significantly lower coefficient of thermal expansion than the coefficient of thermal expansion of the material of said frame, and said tension mask being tensioned to have a fundamental resonant frequency of 90 Hz±20 Hz.

2. The color picture tube as defined in claim 1, wherein said tension mask includes a plurality of parallel strands made from said material having a significantly lower coefficient of thermal expansion than the coefficient of thermal expansion of the material of said frame, and the tensile stress within a strand, divided by the strand length squared, is in the approximate range of 206 to 321.5 grams per $cm^4$ (18.9 to 29.5 pounds per $inch^4$).

3. The color picture tube as defined in claim 1 or 2, wherein said mask is made from a nickel-iron alloy.

4. The color picture tube as defined in claim 3, wherein said mask made from Invar.

5. The color picture tube as defined in claim 4, wherein said frame is made from steel.

* * * * *